US006050746A

United States Patent [19]

McCavour et al.

[11] Patent Number: 6,050,746

[45] Date of Patent: Apr. 18, 2000

[54] UNDERGROUND REINFORCED SOIL/ METAL STRUCTURES

[75] Inventors: Thomas C. McCavour, Etobicoke, Canada; Michael W. Wilson, 13 Silvershore Drive, Sackville, New Brunswick, Canada, E4L 1M7

[73] Assignee: Michael W. Wilson, New Brunswick, Canada

[21] Appl. No.: 08/984,697

[22] Filed: Dec. 3, 1997

[51] Int. Cl.[7] ..... E01F 5/00; E02D 29/00

[52] U.S. Cl. ..... 405/124; 405/126; 405/133; 405/149; 405/151

[58] Field of Search ..... 405/124, 125, 405/126, 146, 150.1, 151, 153, 152, 133, 149

[56] References Cited

U.S. PATENT DOCUMENTS

| | | | |
|---|---|---|---|
| 4,618,283 | 10/1986 | Hilfiker | 405/124 |
| 5,118,218 | 6/1992 | Musser | 405/124 |
| 5,326,191 | 7/1994 | Wilson | 405/124 |
| 5,375,943 | 12/1994 | McCavour | 405/126 |

FOREIGN PATENT DOCUMENTS 2 140 848 12/1984 United Kingdom .

WO 97/47825 12/1997 WIPO .

OTHER PUBLICATIONS

Abdel—Sayed, "Soil Steel Bridges", McGraw–Hill, Chapter 8, pp. 237–271.

Mohammed, "Economical Design for Long–Span Soil Metal Structures", Canadian Journal of Civil Engineering, vol. 23, 1996, pp. 838–849.

*Primary Examiner*—Dennis L. Taylor

*Attorney, Agent, or Firm*—Lee, Mann, Smith, McWilliams, Sweeney & Ohlson

[57] ABSTRACT

A method for controlling deformation of an erected structural metal plate culvert or underpass during backfilling of the erected structure comprises: building progressively a reinforced earth retaining system on each side of the erected structure by alternately layering a plurality of compacted layers of earth with interposed layers of reinforcement to form reinforced earth on each side of the erected structure and securing to each side of the structure each said layer of reinforcement in the reinforced earth, whereby such securement of each said layer of reinforcement to said structure controls deformation of the erected structure during backfilling with the reinforced earth on each side of the structure. The layer of reinforcement may be a plurality of strips extending away from the structure, or a reinforcement mat of interconnected rods.

6 Claims, 9 Drawing Sheets

UNDERGROUND REINFORCED SOIL/ METAL STRUCTURES

SCOPE OF THE INVENTION

This invention relates to a method of backfilling erected structural metal plate culvert or underpass in a manner which avoids deformation of the structure during the backfilling process. This feature of the method is achieved by building progressively a reinforced earth retaining system on each side only of the erected structure by alternately layering a plurality of compacted layers of earth with interposed layers of reinforcement. The structural culvert or underpass is designed to have sufficient structural strength to support anticipated live loads and dead loads. During progressive building of the reinforced earth, the contractor secures to each side of the structure each layer of reinforcement. After the sides of the structure are backfilled overburden may be placed in the usual manner on top of the structure.

BACKGROUND OF THE INVENTION

There is a demand, particularly in remote areas, to provide underpass systems which include overpasses and which can carry not only dead loads, but as well live loads. Such installations may be associated with mining or forestry industries, where vehicles of substantial tonnage pass over or pass under the structural systems. There is also a continuing demand for overpass and underpass structures for highways and other types of roadways where the installation has the usual life expediency and is cost-effective. Other needs for overpasses are in respect of constructing bridges and the like where there is minimal disturbance to the river bed. Such overpasses may also have restrictions in terms of height of the overpass and slope of approach, which restricts to some extent the design of the overpass. Although, many of these demands can be met with concrete structures, they are very expensive to install, are cost prohibitive in remote areas and are subjected to strength weakening due to corrosion of the reinforcing metal and hence, repair.

There have been significant advances in respect of the use of corrugated metal culverts, arch culverts and box culverts, such as described in U.S. Pat. No. 5,118,218 which use sheets of metal having exceptionally deep corrugations where by, using significant material on the crown portions of the culvert and perhaps as well in the haunch portions of the culvert, significant loads can be carried by the culvert design. Ovoid and circular structures are described for example, in U.K. patent application 2,140,848 where wing members are used to increase the load carrying capabilities, and in particular avoid bending of the crown or roof structure as live loads pass thereover.

Applicant has described in U.S. Pat. No. 5,326,191 a reinforced metal box culvert which is provided with a special form of continuous reinforcement along at least the crown or top portion of the culvert. Significant advantages are provided in load carrying characteristics, reduced overburden requirements and the ability to provide large span structures that reduce the cost. Improvements to the box culvert and arch culvert designs are also described in applicants U.S. Pat. No. 5,375,943 and International application PCT/CA97/00407. These systems greatly facilitate the installation of large span structures with the ability to carry live loads under a variety of conditions.

As the installation of corrugated metal culvert structures gain acceptance, there is a greater demand for these structures to accommodate very large spans usually in excess of 6 meters and its well extended sidewall height usually also in excess of 6 meters. Although, these structures can be made to structurally resist both dead and live loads after installation is complete, backfilling of the structure presents, a significant problem, because of the deformation of the crown of the arch structure and/or extended sidewalls of the box culvert structure.

The use of reinforced earth in archway construction is described in U.S. Pat. No. 4,618,283. Such construction technique avoids arching of the structure because the sidewalls of the archway are built as successive layers of reinforced earth which are deposited along side and over top of the structure. The technique involves building on each side of the archway reinforced earth which constitutes vertical support sections, and then building across the top of the arch again using reinforced earth to define the roof of the archway. As the archway is built step-by-step, facings are applied to contain the reinforced earth and prevent such compacted unbound fill of the reinforced earth structure from coming loose and falling into the archway. Such mat faces may be simply attached to the vertical portions of the wire mesh which terminate at the edge of the archway envelope. Alternatives to the facing material include spraying of concrete to provide a liner within the archway or the use of a corrugated metal liner. Optionally, the reinforcing mats of the reinforced earth vertical structures may be attached to the corrugated metal liner. The liner is not designed to carry any structural load either live or dead, instead the live and dead loads are carried by the reinforced earth vertical support sections as well as the reinforced earth roof section.

The use of reinforced earth is also discussed in Abdel-Sayed et al., "Soil-Steel Bridges" McGraw-Hill, Inc- chapter 8, page 269. The use of soil reinforcement by strips of steel attached to the sides of a horizontal ellipse pipe structure are described. The apparent benefit of the use of these steel strips include greater load carrying capacity for the pipe, by reducing axial thrust and almost eliminate bending moments due to live load in the conduit wall and among other things restrain the movement of the pipe during the backfilling operation. However, the authors of that book sincerely doubt the benefit of connecting the steel strips to the pipe, because it would restrain movement of the pipe during backfilling and prevent the development of full soil support to the pipe and as well create the hard point effect at all locations where the pipe is connected to the steel strips. It is generally understood by those skilled in the art when backfilling pipe structures that it is important to allow the side segments of the pipe to mobilize so that the maximum support of the soil can be achieved in carrying live and dead loads. The authors however, do believe that the use of steel strips above the pipe is beneficial and is indeed similar to the structure advocated in U.S. Pat. No. 4,618,283 where a reinforced earth is provided above the archway as well as on the sides.

It is well known that the thrust in a soil-metal structure is the product of the radius of the structure times the soil pressure surrounding the structure. In a typical installation, an active earth pressure is exerted on the sidewalls of the structure during backfilling. This active pressure pushes the sidewalls in and the crown or top wall up. As the backfilling progresses over the crown, an active pressure is applied to the top of the structure pushing the crown down and the sidewall out. The pressure on the sidewall then changes from active to passive. It is obvious, in this relationship, that since the thrust is fairly constant, small radius structures will produce large pressures and large radius structures will produce small pressures. The concerns of Abdel-Sayed relate to a horizontal ellipse structure in which the radius of the sidewall is much less than the radius of the crown. In a horizontal ellipse, circular pipe, pipe- arch or plain arch, the sidewall is encouraged to move inward during backfilling in order to develop more passive pressure, when the crown is backfilled and the sidewall pushes out. H. Mohammed et al "Economical Design for Long-Span Soil-Metal Structures" Canadian Journal of Civil Engineering, vol. 23, 1996, pages 838–849 describe the use of reinforced soil with horizontal ellipse culvert having a larger radius crown and a small radius sidewall. The reinforcement of the reinforced soil is attached only to the upper sidewall of the horizontal ellipse culvert and reinforced soil to a depth of 2 meters is provided above the culvert. This system is designed for withstanding live and dead loads on the structure, but does not in any way address the problems associated with backfilling because with horizontal ellipse structures, backfilling is not a significant problem.

In a re-entrant arch type culvert or a box type culvert with an extended sidewall, the situation is substantially different. In a re-entrant arch type culvert the radius of the sidewall is quite large compared to the radius of the crown. The passive pressure required to stabilize the sidewall is much less than in a horizontal ellipse culvert.

In a box culvert, with an extended sidewall, the radius of the sidewall is infinite since the wall is straight. There is no passive pressure on the sidewall pushing it out. Instead the sidewall must resist active pressure from backfill which pushes in.

Quite surprisingly, in accordance with this invention the use of reinforced earth wherein the reinforcement is attached to the side portions of the culvert or underpass during backfilling provide a significant benefit in minimizing or preventing deformation of the crown and sidewall of the culvert or underpass.

SUMMARY OF THE INVENTION

One aspect of the invention is directed to a method for controlling deformation of sidewall portions of an erected structural metal plate arch culvert or box culvert during backfilling of and placing overburden on the erected structure, where the radius of the sidewall of the structure is greater than the radius of the top of the structure. The method comprises:

building progressively a reinforced earth retaining system on only each side of the erected structure by alternately layering a plurality of compacted layers of fill with interposed layers of reinforcement to form reinforced earth on each side of the erected structure; where the structure is designed to have sufficient structural strength to support anticipated live loads and dead loads;

securing to each sidewall of the erected structure each said layer of reinforcement during progressive building of the reinforced earth, whereby such securement of each layer of reinforcement to each the sidewall of the structure controlling deformation of the sidewalls and top of the erected structure during backfilling with the reinforced earth on each side of the structure; continuing the building of the reinforced earth retaining system upwardly of the sidewalls towards the top where a last layer of the reinforcement is connected below the top and placing overburden of unreinforced fill on the top of the structure.

BRIEF DESCRIPTION OF THE DRAWINGS

Preferred embodiments of the invention are described with respect to the drawings wherein:

FIGS. 2, 2*a*, 2*b*, 2*c*, 2*d* and 2*e* are views of representative types of culverts;

DETAILED DESCRIPTION OF THE PREFERRED EMBODIMENTS

Figure 1:
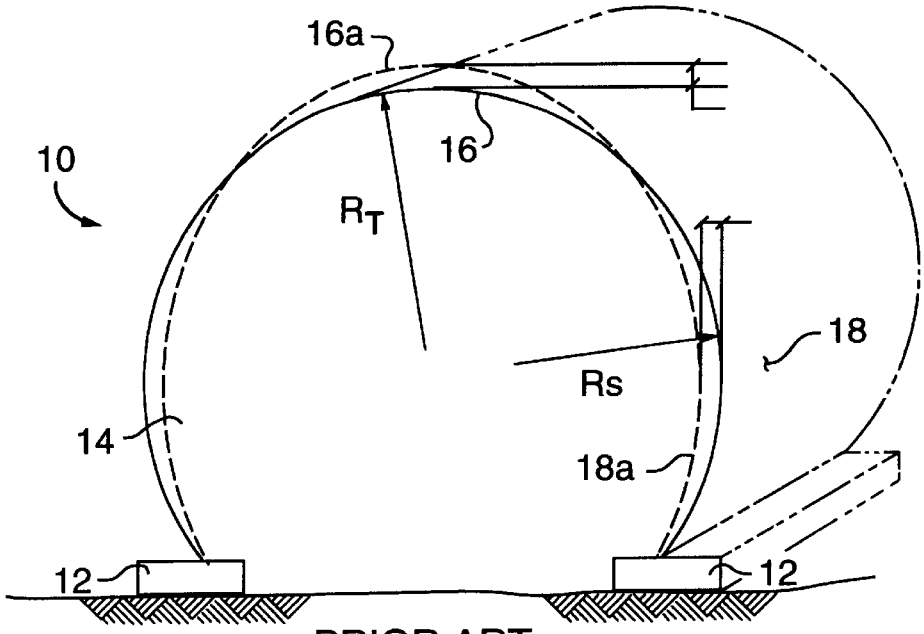
PRIOR ART FIG.1
FIG. 1 is a perspective view of a representative type of an arch culvert.

Although, it has become possible to make and construct large and/or long span soil metal structures, for example as described in applicants U.S. Pat. Nos. 5,326,191 and 5,375,943 and PCT/CA97/00407, their use has been limited, because during backfilling procedures, the capacity of the bolted joints of the structural plate and as well the capacity of the corrugated metal plate may be exceeded to the extent that the structure is irreversibly deformed and can no longer support designed for loads. Soil/metal structures under high backfilled conditions are subject to various types of deformation depending upon the design of the structure. High profile structural metal plate re-entrant arch, vertical ellipse, horseshoe, pear and box-shaped culverts and underpasses have been used extensively for the construction of various highway and railway passes and overpasses. In all of these structures the radius of the sidewall is greater than the radius of the top of the structure. These types of structures require a large vertical clearance and one of the major difficulties in installing such a structure is that during backfilling, peaking deformation in the crown of the structure occurs. This deformation is caused by horizontal pressure exerted by the soil on the structure during backfilling. The horizontal pressure can cause failure of the crown due to combined bending and axial stresses in the corrugated metal plate or bolted joints. A variety of techniques have been used in the past to control peaking or crown failure. They include compaction in the vicinity of the culvert sidewall, stiffening of the crown by the use of concrete pads, continuous reinforcement, placing soil on top of the structure before backfilling and piling earth against the structure inside sidewalls before backfilling. All of these procedures are costly and can become dangerous and possibly result in failure of the structure during the backfilling procedure. It is very difficult to control these procedures and hence, inconsistent results are achieved which can lead to failure of the structure. Similar concerns exist in the respect of backfilling box culverts which in particular have high extended sidewalls. This is particularly important where the shape of the box culvert has been modified to create a high headroom structure. However, during backfilling of the structures, the backfill soil exerts lateral pressure causing the corrugated plate to bend inward and become over stressed due to the combination of axial and bending forces. This can result in failure of the structure even before the installation is complete.

An example of such an incident has been recently reported in respect of a failure in British Columbia, Canada where, the design involved the placement of backfill around the metal arch so as to form an arch/soil structure that supports the highway and vehicle loads. Backfill is basically "engineered soil" that is carefully placed at the sides and over the top of the metal arch. The fill acts in two ways. In the initial stages, as it is placed on either side, it acts as a load that pushes the side walls inward and the crown upward. Great care is required to balance the fill on either side so that the deflections are symmetrical and controlled to low values. In the final stages it acts to support the arch so that the arch is able to carry the highway and traffic loads to the foundation.

Large culvert structures such as this one are sometimes so flexible that the side fill cannot be carried to the level of the crown without causing a failure. Instead side filling is stopped when the upward movement of the crown reaches a target deflection, in this case about 0.10 m. Fill is then placed over the crown of the structure. This causes some downward movement of the crown, and curtails further rise of the crown as the side fill is brought to the crown level. This stage of backfilling is very critical if the structure has not been designed to resist direct backfilling to the crown level. The structure in British Columbia failed in an effort to control peaking during construction.

A representative re-entrant arch-type culvert 10 is shown in FIG. 1. The arch culvert installation 10 is erected by assembling on footings 12 corrugated structural metal plate 14, which when bolted together in the usual manner provides the erected structure of FIG. 1. The problem associated with backfilling structures of this size particularly large span structures having a span in excess of 6 meters is the peaking in the crown portion 16. Peaking is caused by the backfilling soil forcing the sidewalls 18 inwardly as shown at 18*a* and hence, forcing the crown upwardly as shown in 16*a*. Once the plastic moment of the structure is exceeded the crown deforms and at that point the entire structure may collapse or if the deformation is arrested, radical measures still have to be taken to selvage the structure and put it into service.

With the box culvert system 20 of FIG. 2, these structures are erected on footings 22. In the usual manner the sidewalls 24, haunch 26 and crown 28 are erected out of bolted corrugated structural metal plate. During backfilling of the structures particularly where the sidewalls 24 are vertically extended, the capacity of the sidewalls can be exceeded causing deformation therein which might result in failure of the structure before the installation is complete.

In general the structures which can be backfilled in accordance with this invention and not cause failure characteristically have a radius for the sidewall being greater than the radius of the top structure. Structures which have these characteristics include re-entrant arch, vertical ellipse, horseshoe, pear and box-shaped culverts or underpasses. Examples of these structures are shown in FIGS. 1 and 2*a*, 2*b*, 2*c*, 2*d* and 2*e* which are respectively re-entrant arch, box, vertical ellipse, pear and horseshoe shapes.

Figure 3:
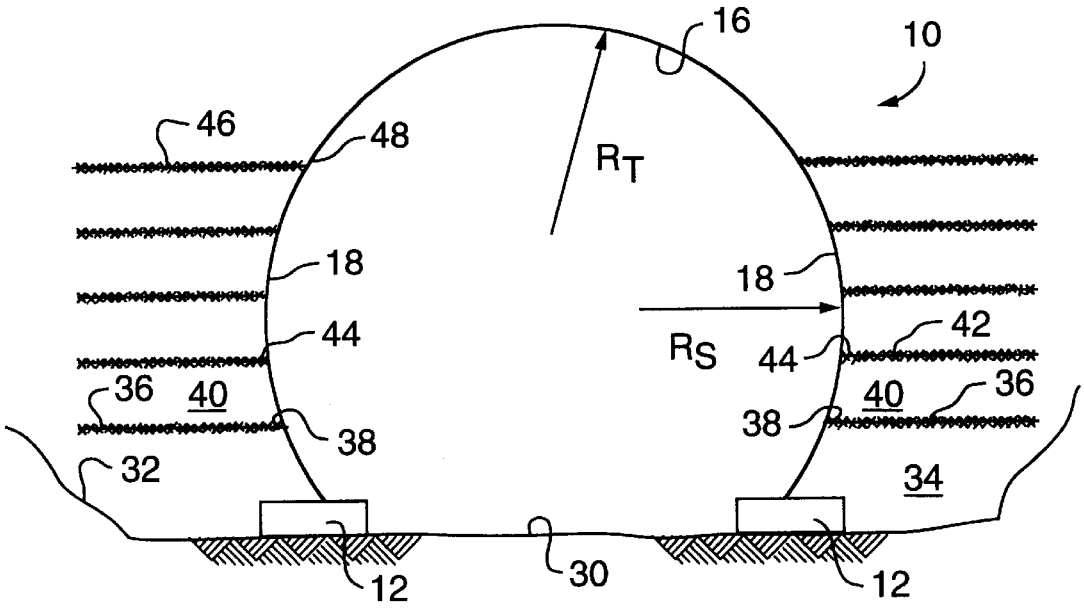
FIG. 3 is a section through an arch culvert having reinforced soil developed on each side of the culvert to preclude deformation during backfilling with the reinforced soil.
Figure 2A:
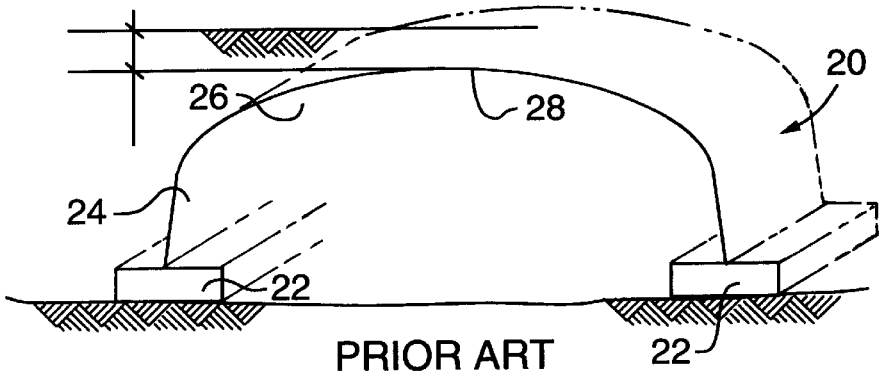
PRIOR ART FIG.2A
Figure 4:
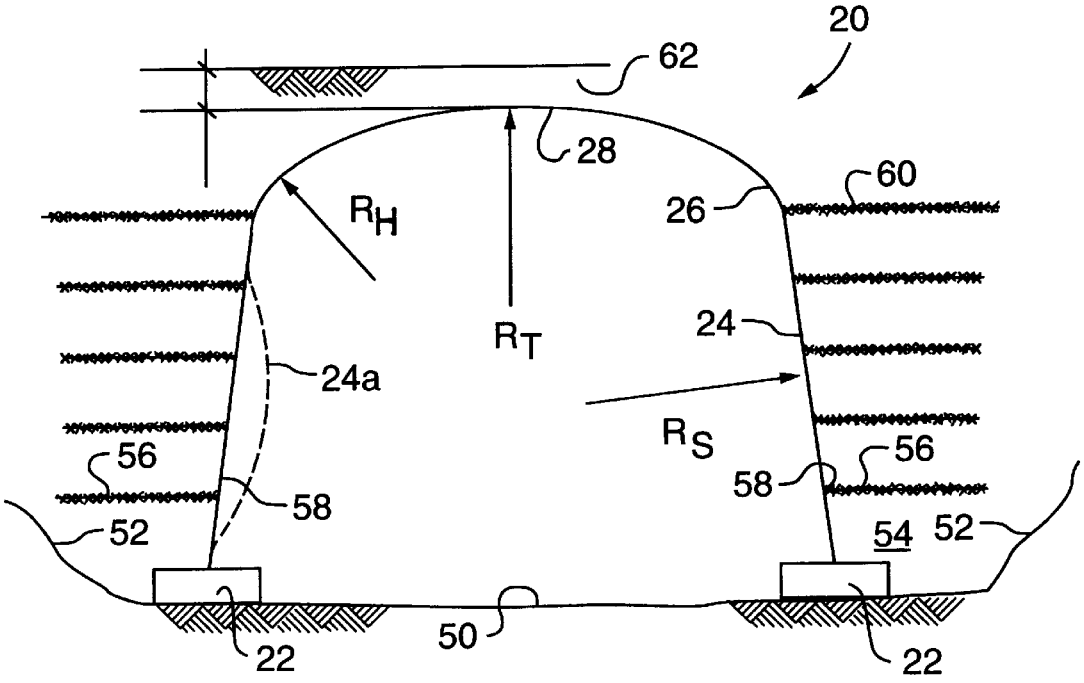
FIG. 4 is a section through a box culvert having extended sidewalls and the development of reinforced soil at each side of the box culvert to prevent deformation during backfilling.
Figure 2B:
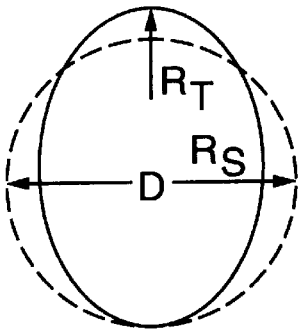
Figure 2C:
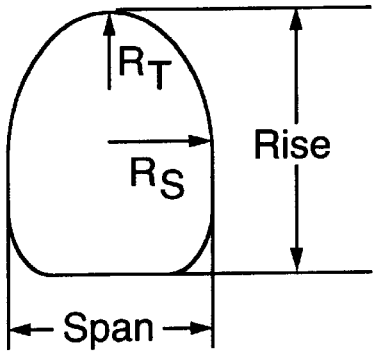
Figure 2D:
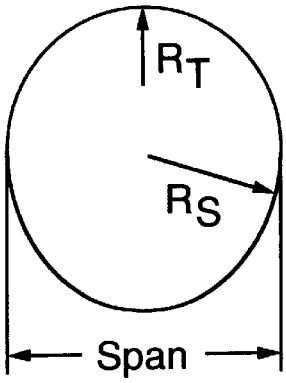
Figure 2E:
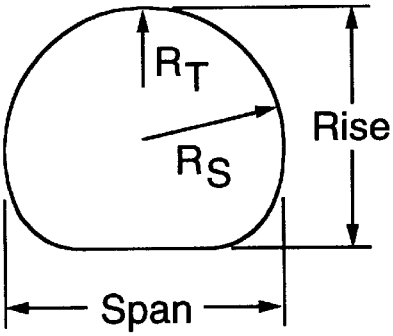

In accordance with this invention as demonstrated in FIGS. 3 and 4, a method of backfilling is provided which controls deformation in the erected structure where the Rs (radius of sidewall) is greater than Rt (radius of top). It should be clarified that these parameters for assessing when the invention is best applied to a structure, could also be best viewed as applying when the structure is generally taller than wider. This is particularly true for box culverts which can now with this invention be considerably taller than their span. Furthermore when considering the radius of the sidewall of a box culvert, Rs is approaching infinity. The area may be excavated to accommodate the structure 10 and provide a bed of material 30 with upward slopes 32. The area between the slopes and the sidewalls 18, and perhaps the area above the crown 16 has to be backfilled to complete installation of the structure 10. In accordance, with this invention reinforced earth is installed on each side of the structure 10 in a manner which minimizes deformation of the crown or controls deformation of the crown to the extent that the design limits and capacity of the crown are not exceeded during backfilling. Reinforced earth has been used extensively in providing retaining walls, headwalls and the like such as described in the aforementioned U.S. Pat. No. 4,618,283.

The reinforced earth is developed by alternately layering a plurality of compacted layers of fill with interposed layer of reinforcement to form the reinforced earth as shown in FIG. 3. Fill is provided on top of the excavation bed 30 and along the slopes 32 to form a first layer 34 of compacted fill. The fill may be any type of granular material such as various types of sand, gravel, broken rock and the like. The unbound fill even when compacted remains as a unbound granular fill and has a relatively low resistant to sheer forces. After the first layer of compacted fill is installed a layer of reinforcement 36 is laid down where that layer of reinforcement 36 is connected to each culvert side 18 at 38 to secure the reinforcement to the sidewalls. Such manner of connection will be described with respect to the embodiments of FIGS. 5 to 9. The next layer of compacted soil 40 is then applied over top of the reinforcement 36. After the layer 40 is completed the next layer 42 of reinforcement is laid down on compacted layer 40. Reinforcement layer 42 is connected to the sidewalls at 44. This procedure is repeated several times as required to backfill the excavated space between the slopes and the sidewalls of the structure. Usually the last layer of reinforcement 46 is connected to the sidewall areas 18 at 48 which is well below the crown or top 16. The inherent capacity of the crown portion during the remainder of the backfilling resists the forces of the compacted fill so that any further peaking of the crown is resisted. The backfilling is then completed to the level of the crown and the usual overburden is then applied. The last layer of backfill on top of the reinforcement 46 is compacted only to the extent necessary to provide the needed resistance to sidewall movement which could affect crown peaking.

By following the procedure of this method the reinforced soil system controls deformation and/or failure of the crown or top portion of the arch culvert. As appreciated, however, backfilling with reinforced soil continues up the side of the structure until it becomes progressively redundant as the backfill extends above the crown. The reinforcement layers 36 and 42 are put in tension as backfilling with reinforced soil continues up each side of the structure. The reinforcement as connected to the sidewalls resists inward movement of the sidewalls 18, and thereby, prevents peaking of the crown. The installation of the reinforced soil system does not have to be in accordance with the reinforced soil system of the prior art. With this invention, attaching the reinforcement to the sidewalls of the structure performs only an interim function which becomes obsolete at the end of the backfilling operation. The reinforcement layers only need be sufficient in number to resist deformation of the sidewalls during the backfilling operation. Therefore, the height of the compacted fill for each layer may be considerably greater than what would normally be employed in reinforced soil installation particularly when forming reinforced vertical columns. The compacted fill may exceed the usual 0.3 to 0.9 meter height. The reinforcements may be shorter in length than what is usually employed and may be constructed of inexpensive materials, because of the momentary need that the reinforcement is put in tension only during the backfilling operation. Where the installation requires, the reinforcement may be made of biodegradable materials having sufficiently high tensile strength so as to not affect the immediate environment of the design of the backfill. Overburden is developed in the usual manner such that when the overburden is in place and whatever type of overpass is installed both the live and dead loads applied to the structure are accommodated by the capacity of the corrugated metal plate. For example, with the design criteria set out in applicant's above noted U.S. patents and International application, the live and dead loads are accommodated by the backfilled structure in the usual manner where the loads are resisted by the structural strength of the metal plate, as well as the backfill resisting outward movement of the sidewalls which is commonly referred to as "Positive Arching."

Similarly with the installation of FIG. 4, an area may be excavated to provide a bed 50 with slopes 52. The footings 22 are formed on the bed 50 and the structure 20 erected on the footings 22. In accordance with this embodiment the sidewalls 24 having an Rs value equal to infinity, are extended vertically to provide increased headroom to accommodate trains, large tonnage vehicles and the like. In this type of installation a suitable track or roadway is built on the excavated bed 50. Backfilling of such an erected structure can deform the height extended walls of the box culvert as indicated at 24*a*. Such deformation if it exceeds the capacity of the structural plate can result in failure and collapse the structure. In accordance with this invention and as with the embodiment of FIG. 3 a reinforced soil is developed in each side of the structure during the backfilling operation where the reinforcement resists under tension such inward deformation of the sidewalls. The reinforced soil system is developed on each side of the structure by providing a first layer of compacted fill 54, on top of which a layer of reinforcement 56 is laid down and secured at 58 to the sidewalls 24. This procedure is repeated several times as the excavated space is backfilled with the reinforced soil where the last layer 60 of reinforcement is connected to the structure usually in the haunch region 26. At this point any further reinforcement connection becomes redundant. The last layer of backfill may be compacted as required on top of the reinforcement 60 to provide the necessary resistance to deformation in the crown portion 28 and the usual overburden 62 then applied to the crown.

In accordance with this invention, erected structures may be backfilled in an efficient controlled cost-effective manner, to insure that the design limits of the structure during its life cycle are retained. The backfilling procedure does not require special fill or special techniques other than those already commonly used in developing reinforced soils. The procedure for securing the reinforcement to the sidewalls is achieved in a variety of ways where localized stress on the structure is minimized. This invention now permits the installation of culverts and underpasses, that could not have been achieved in the past. The span between the sidewalls may be well beyond usual design limits which for example with box culverts is an approximate maximum height of 3.5 m and maximum span of 3.3 m to 8 m. It is appreciated that with the advantages provided by our systems defined in U.S. Pat. Nos. 5,326,191, 5,375,948 and International application PCT/CA97/00407 these spans may be increased up to approximately 14 m. With the additional advantages of this invention, the height of the box culvert may be increased well beyond 6 m and may be as high as 12 m or more to accommodate traffic passing through a narrow but high underpass, such as a double car train. Such a structure greatly reduces costs because it is no longer required to provide a larger span in order to provide a significant vertical height for the underpass. The same considerations apply to re-entrant arches which normally have heights of 6 m and spans of 16 m. These dimensions may be significantly increased with the advantages of this invention, particularly, in combination with the features of the strengthening ribs of PCT/CA97/00407. The design of the structural plate no longer has to be made of material of excessive thickness to withstand backfilling instead the plate may be of a thickness to withstand the live and dead loads when placed under positive displacement. It is also appreciated that the design of the metal plate for the structure need not necessarily be corrugated because of the ability to resist deformation during backfilling providing the plate design still meets the design criteria for structural support, in accommodating live and dead loads. The corrugated metal plate may be of the usual steel alloys which are optionally galvanized or of aluminum alloys.

Figure 5:
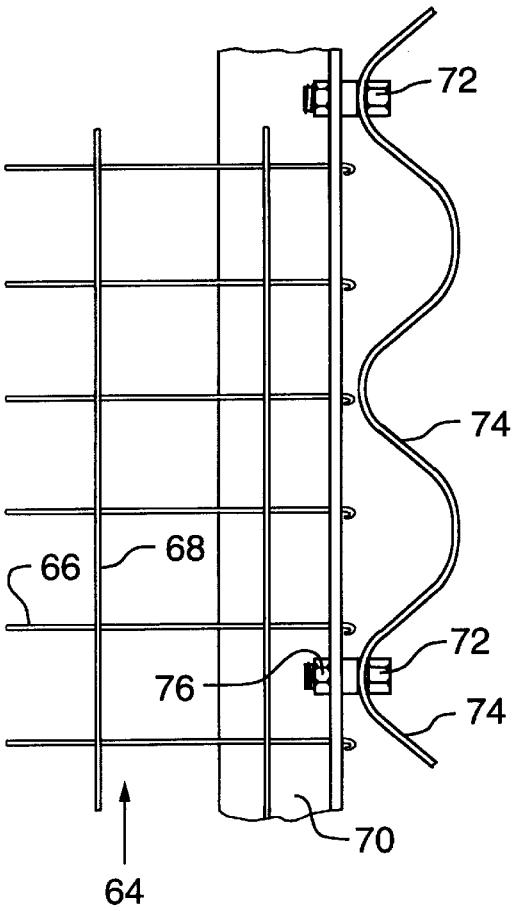
FIG. 5 is a section through a portion of the corrugated metal plate of the erected structure having the reinforcement of the reinforced earth secured to the culvert sidewall.
Figure 6A:
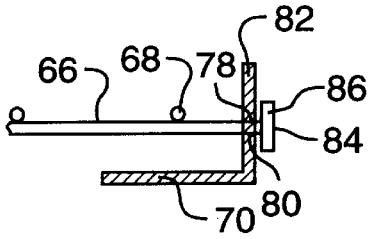
FIGS. 6*a, b, c* and *d,* are sections through alternative embodiments for connecting the reinforcement to an angle iron which is connected to the culvert sidewall.
Figure 6B:
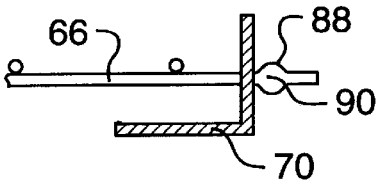
Figure 6C:
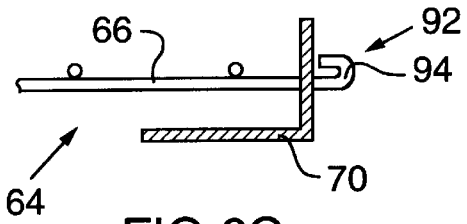
Figure 6D:
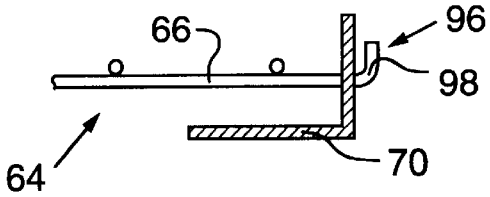
Figure 7A:
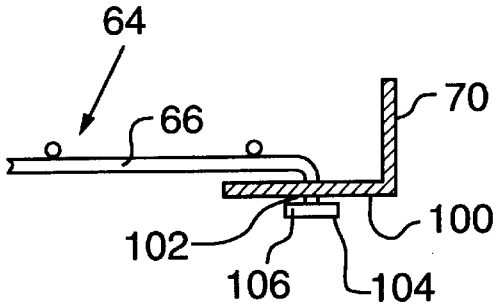
FIGS. 7*a, b, c, d* and *e,* are sections through alternative embodiments for the reinforcement connection.
Figure 7B:
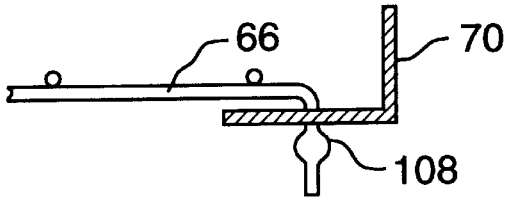
Figure 7C:
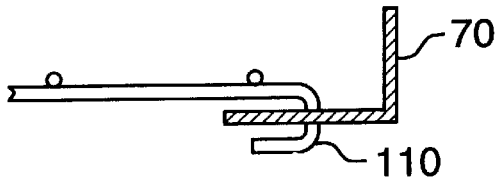
Figure 7D:
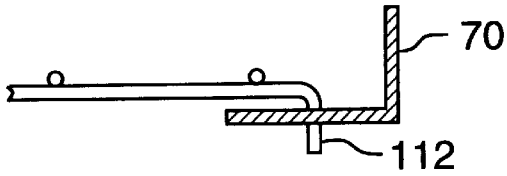
Figure 7E:
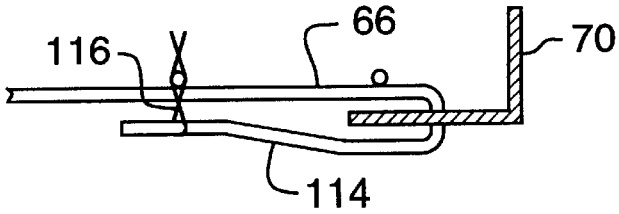

One embodiment for connecting the reinforcement to the sidewalls of the structure is shown in FIG. 5. The reinforcement 64 is in the form of a wire grid mat, comprising a plurality of interconnected intersecting rods 66 and 68. The rods are connected for example, in accordance with the embodiments of FIG. 6 or 7 to a length of structural material which distributes the loads along the sidewall of the arch or box culvert. An angle iron 70 may be used which is bolted at 72 to the interconnected corrugated plates 74. Bolts are normally used to connect the plates 74 hence, a second nut 76 may be used to connect the angle iron to the bolt 72 in assembling the structure. As is customary the spacing between the bolts is such that at every other row or every third row of bolts, a reinforcement mat may be installed as the sides of the structure are backfilled with the reinforced earth.

The embodiments of FIGS. 6 and 7 shown various types of connection of the reinforcing to the angle iron 70. As shown in FIG. 6*a,* the longitudinally extending rods 66 have their end portions 78 extend through an opening 80 in the upright portion 82 of the angle iron. The distal end 84, of each longitudinally extending rod 66 is then deformed to provide a button 86, which is greater than the opening 80 in the upright portion, so as to retain the reinforcement in the angle iron. The deformation of the distal end and forming the button 86, is such to accommodate the tensile stress applied to the reinforcement during the backfilling of the sidewall of the structure. As shown in FIG. 6*b* the distal end 88 of the longitudinally extending rod 66 is flattened to define a butterfly button 90 which holds the rod in place. As shown in FIG. 6*b* the distal end 92 is bend upon itself to define and enlarged end 94 which retains the reinforcement 64 under tension in the angle iron 70. As shown in FIG. 6*d,* the distal end 96 is bent upwardly to form leg 98 which retains the reinforcement in place in the angle iron 70.

As shown in FIG. 7, an alternative arrangement may be provided where the reinforcement 64 has the longitudinally extending rods 66 secured to the lower leg 100 of the angle iron 70. The lower leg 100 has an opening 102 formed therein to accommodate the rod 66 and have at its distal end 104 a deformed button 106 to secure the rod in place. Similarly with embodiments of FIGS. 7*b,* 7*c* and 7*d,* the respective distal end 108, 110 and 112 is deformed to secure the rod 66 in the lower leg portion 100. In the embodiment in FIG. 7*e* the rod 66 is bent upon itself at 114 and secured in place by rod wire 116.

Figure 8A:
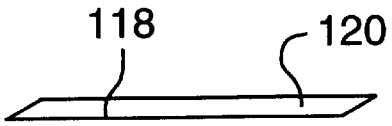
FIGS. 8*a* to 8*l* are top plan views of various types of reinforcement.
Figure 8B:
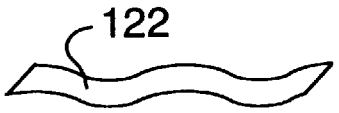
Figure 8C:
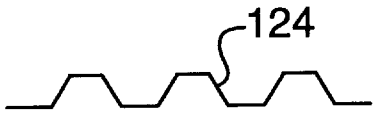
Figure 8D:
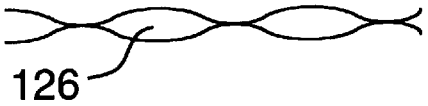
Figure 8E:
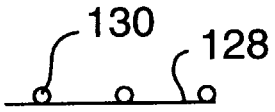
Figure 8F:
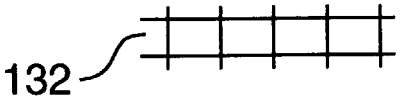
Figure 8G:
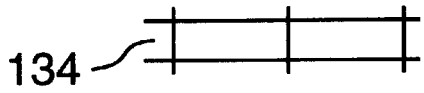
Figure 8H:
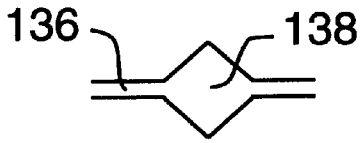
Figure 8I:
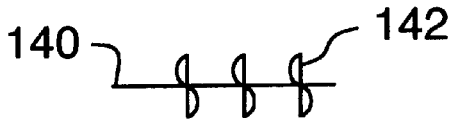
Figure 8J:
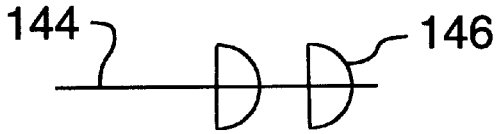
Figure 8K:
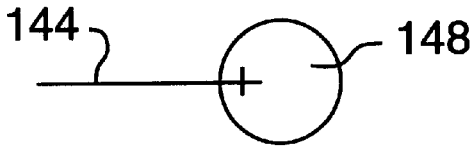
Figure 8L:
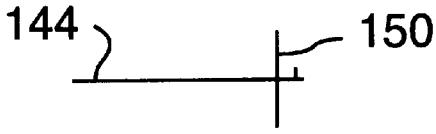
Figure 9A:
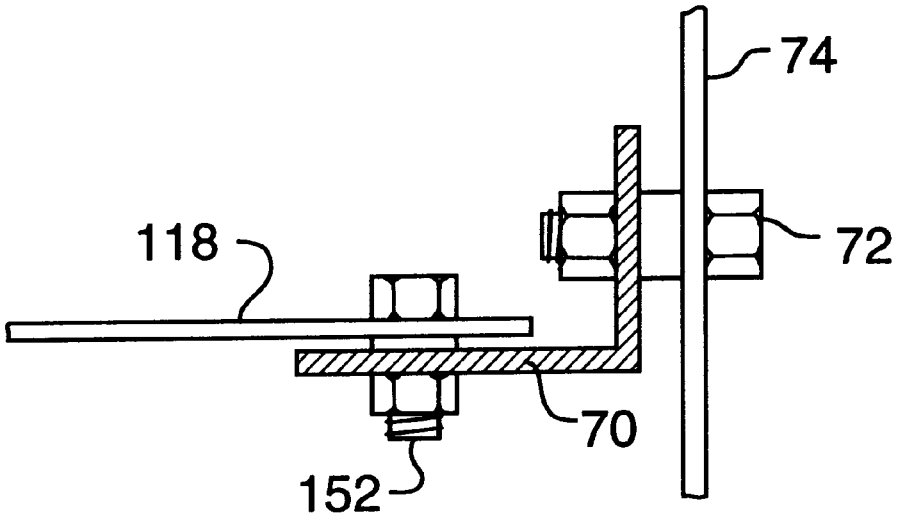
FIG. 9 is a section in side elevation for connecting reinforcement to culvert sidewall.
Figure 9B:
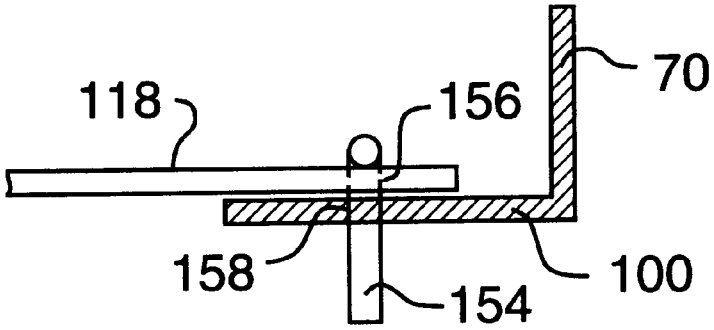

It is appreciated that the reinforcement interposed each compacted layer of fill for the reinforced soil may take on a variety of structures and shapes and be made of a variety of materials, because of the temporary nature that the reinforcement is required to perform a function during the backfilling operation. In addition to the grid structure set out in FIG. 5, it is understood that other types of reinforcement may be used such as, individual strips 118. As shown in FIG. 8*a,* each end 120 of the strip is connected to the culvert sidewall either directly or via a load distributing device such as the angle iron 70 of FIG. 5. This type of strip is very common to the system originally developed by "VIDAL" which is described for example in French patent 75/07114 published Oct. 1, 1976. As shown in FIG. 8*b* the strip 122 may be corrugated to enhance its load carrying capacity. Other types of corrugations are shown in FIG. 8*c* for strip 124 and spiral 126 in FIG. 8*d.* In FIG. 8*e* the reinforcement may be rods 128 with enlargements 130. Alternatively, ladder like arrangements 132 and 134 may be used such as in FIG. 8*f* and 8*g*.

The strips may also have enlarged portions such as shown for strip 136 with enlarged sections 138. Alternatively, the strip 140 of FIG. 8*i* may have auger or propeller shaped units 142. The outwardly extending rods 144 of FIGS. 8*j, k* and *l,* may have enlarged disks 146, enlarge concrete masses 148 or flat plate 150 connected thereto to anchor the strips in the compacted fill.

It is appreciated that for the various types of reinforcement the strips and/or grid may be made of any type of metal composite or plastic which has sufficient structural strength to resist movement in the sidewall of the erected structure during backfilling. Although some movement in the sidewall will be accommodated by the design the strips cannot fail to the extent that movement beyond the design limit in the sidewalls is experienced. The materials for the reinforcements in the form of mats, grids, strips and the like can be of recycled materials, inexpensive forms of structural materials and the like. The reinforcement does not have to be galvanized or in any other way treated to resist corrosion because of the temporary functional nature of the reinforcement. In that respect the reinforcements may be made of high tensile strength biodegradable materials such as certain types of plastics and composites and the like which are particularly suited to the immediate environment.

With respect to the use of strips as reinforcement, the load distributing member 70, which is in the form of an angle iron is connected to the sidewall 74 of the plate by bolts 72. The strip for example 118 is then bolted to the angle iron 70 by bolt 152 to complete the connection. Alternatively, in FIG. 9*b* the angle iron 70 may have the strip 118 connected thereto by the use of a pin 154, which extends through an aperture 156 in the strip and 158 in the leg 100 of the angle iron 70.

Figure 10:
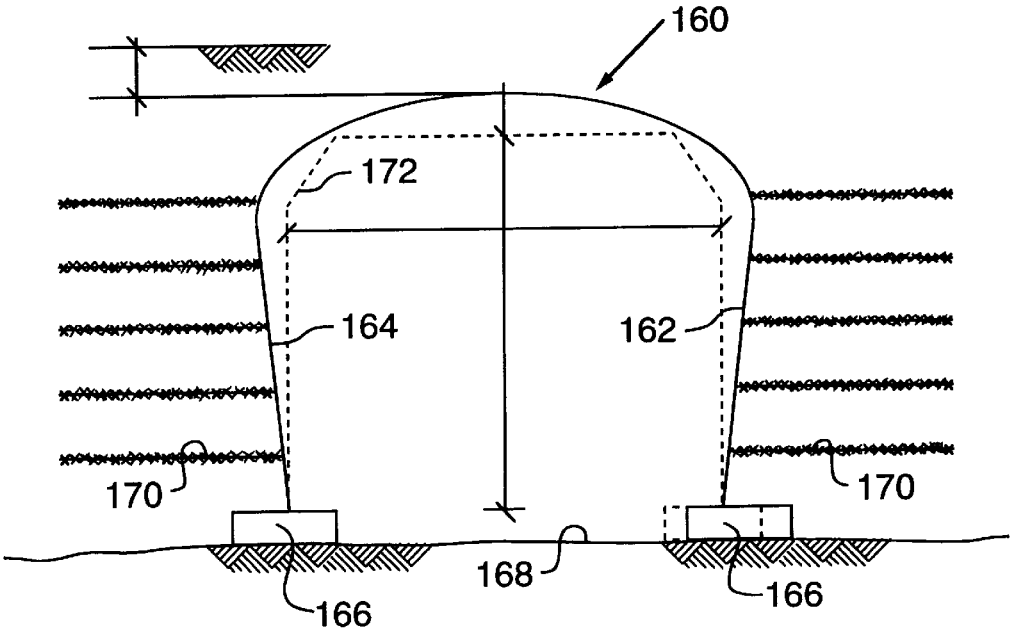
FIG. 10 shows an alternative design for a box culvert having vertically extended sidewalls.

A significant advantage realized with this invention is that the erected structure can be of oddly configured shapes to accommodate special needs in the installed underpass and overpass. As shown in FIG. 10, a box culvert structure 160 has a vertical sidewall 162 and an obliquely sloped sidewall 164. This odd shaped structure may be used to accommodate train traffic and the like where the cars tilt outwardly on curves. Normally the culvert design 160 needs to be of an enlarged span to accommodate the tilt of rail car traffic. In accordance with this embodiment a smaller span between the sidewalls 162 and 164 can be used where sidewall 164 slopes obliquely outwardly to accommodate tilt of car traffic. The structure 160 may be mounted in the usual manner on footings 166 where the railway bed is developed on the excavated base 168. The reinforcement 170 as connected to the sidewalls insure that the sidewalls do not deform during backfilling and furthermore, insure that the obliquely oriented sidewall 164 retains that orientation during backfill to achieve the desired result of an enlarged space in region 172. This special shape accommodates the tilting rail cars.

It is appreciated that other sidewall configurations may be used with the installation method of this invention. The sidewalls of the box culvert can also slope acutely inwardly and the configuration of the arch sidewalls may also be varied to accommodate other special needs.

Although preferred embodiments of the invention have been described herein in detail, it will be understood by those skilled in the art that variations may be made thereto without departing from the spirit of the invention or the scope of the appended claims.

We claim:

1. A method for controlling deformation of sidewall portions of an erected structural metal plate arch culvert or box culvert during backfilling of and placing overburden on the erected structure, where the radius of the sidewall of the structure is greater than the radius of the top of the structure, said method comprising:

i) building progressively a reinforced earth retaining system on only each side of said erected structure by alternately layering a plurality of compacted layers of fill with interposed layers of reinforcement to form reinforced earth on each side of said erected structure; where said structure is designed to have sufficient structural strength to support anticipated live loads and dead loads;

ii) securing to each sidewall of said erected structure each said layer of reinforcement during progressive building of said reinforced earth, whereby such securement of each said layer of reinforcement to each said sidewall of said structure controlling deformation of said sidewalls and top of said erected structure during backfilling with said reinforced earth on each side of said structure; continuing said building of said reinforced earth retaining system upwardly of said sidewalls towards said top where a last layer of said reinforcement is connected below said top; and iii) placing overburden of unreinforced fill on said top of said structure.

2. A method of claim 1, connecting to said sidewalls a plurality of strips extending laterally away from said side walls and resting on top of a layer of compacted earth before backfilling and compacting the next layer of earth on top of said plurality of strips.

3. A method of claim 1, connecting to said sidewalls a mat of interconnected rods extending laterally away from said sidewalls and resting on top of a layer of compacted earth before backfilling and compacting the next layer of earth on top of said mat.

4. A method of claim 1 wherein means is provided on said sidewall for connecting said reinforcement to said sidewalls, connecting said connecting means at each predetermined level for the respective reinforcement.

5. A method of claim 4 compacting each said layer of earth to approximately 0.3 to 2.0 meters deep.

6. A method of claim 4 bolting said connecting means on said sidewall metal plate in rows along said structure where vertical spacing between said rows determines depth of each layer of compacted earth.

* * * * *